United States Patent [19]

Iversen

[11] Patent Number: 4,575,965

[45] Date of Patent: Mar. 18, 1986

[54] SECURITY GRILLE APPARATUS FOR DOORS AND WINDOWS

[76] Inventor: Elmer A. Iversen, Theatre Dr. 2, Paso Robles, Calif. 93446

[21] Appl. No.: 684,380

[22] Filed: Dec. 20, 1984

[51] Int. Cl.[4] ..... E06B 7/00

[52] U.S. Cl. ..... 49/50; 49/57; 49/61

[58] Field of Search ..... 49/57, 54, 50, 55, 56, 49/61

[56] References Cited

U.S. PATENT DOCUMENTS

| | | | |
|---|---|---|---|
| 1,110,678 | 9/1914 | Franklin | 49/57 |
| 1,591,078 | 7/1926 | Biddle | 49/57 X |
| 2,605,517 | 8/1952 | Rucker | 49/54 |
| 2,803,074 | 8/1957 | Brokish | 49/55 X |
| 4,059,413 | 11/1977 | Forgione | 49/56 |
| 4,283,881 | 8/1981 | Moore et al. | 49/57 X |
| 4,325,203 | 4/1982 | Wicks | 49/57 |
| 4,400,912 | 8/1983 | Wicks, Sr. | 49/57 |
| 4,452,011 | 6/1984 | Trombettas | 49/56 |

*Primary Examiner*—Philip C. Kannan

*Attorney, Agent, or Firm*—Daniel C. McKown

[57] ABSTRACT

Apparatus for securing a window or door that has a slidable sash includes a grille that has a set of spaced parallel bars that extend in the direction of motion of the slidable sash. The grille fits into the frame of the window and is secured there by a locking bar or other means. A flange on the slidable sash includes holes through which the bars pass as the sash is moved. The flange is captive on the bars and serves to prevent an intruder from pushing the grille into the room from the outside. The grille can be quickly removed from inside the building by an occupant who must flee in the event of fire or other emergency.

6 Claims, 4 Drawing Figures

FIG. 1
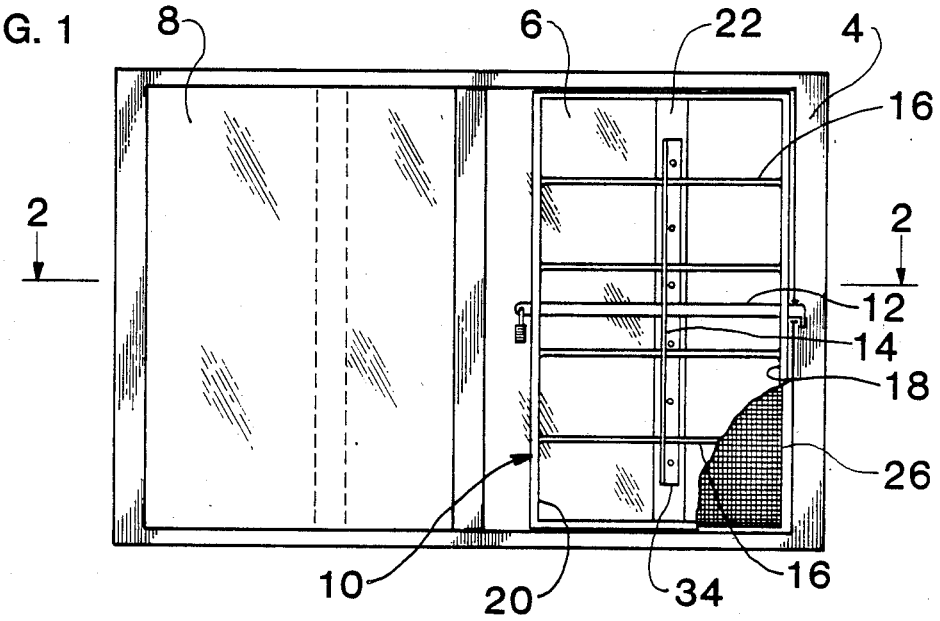
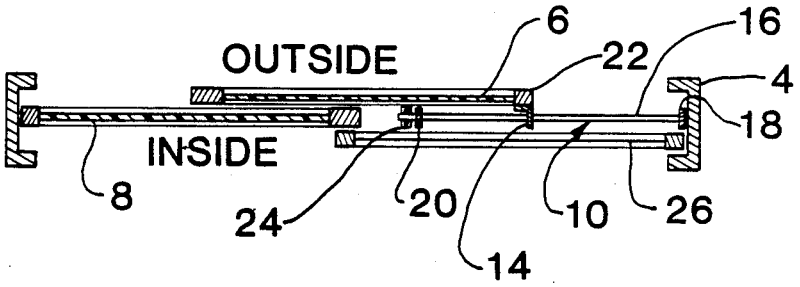
FIG. 2
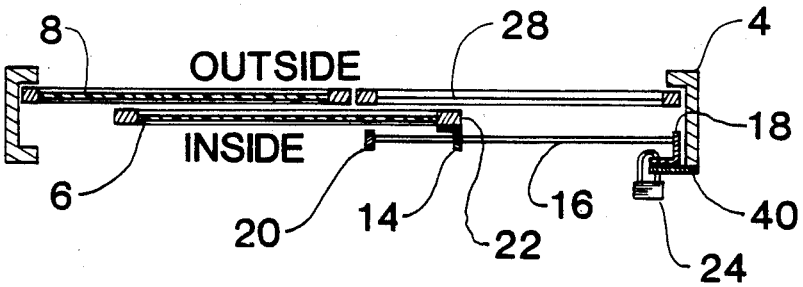
FIG. 3

SECURITY GRILLE APPARATUS FOR DOORS AND WINDOWS

BACKGROUND OF THE INVENTION

1. Field of the Invention The present invention is in the field of security hardware and more particularly relates to a security grille apparatus for installation on sliding doors and windows.

2. The Prior Art

In Brokish U.S. Pat. No. 2,803,074, issued Aug. 20, 1957, there is shown a gate that has a barred passage through it. It is a permanent installation in which the bars move aside by telescoping into tubes, to permit passage through the gate. In contrast, in the present invention the bars remain stationary to prevent passage through a door or window. In Wicks U.S. Pat. Nos. 4,325,203 and 4,400,912 shows a device for securing patio doors and windows. The device includes bars that are suspended from an overhead track and are held in a spaced array by bars that extend at right angles. In contrast to the present invention, no part of the window or door moves along either set of bars, and it appears that the entire window or doorway must be barred.

In Trombettas U.S. Pat. No. 4,452,011 issued June 5, 1984 there is shown a grille system for a window in which the vertical and horizontal bars of the grille are riveted at their intersections.

In Rucker U.S. Pat. No. 2,605,517 issued Aug. 5, 1962, there is shown a grille that is pivotally attached to a window frame, so as to lie against the window when the window is shut and to bar the space below the lower sash when the latter is opened. The grille cannot accommodate various amounts of opening.

In Moore, et al. U.S. Pat. No. 4,283,881 issued Aug. 18, 1981, there is shown a casement window security guard that consists of a single channel that is secured to the sides of the casement and from which several bars extend vertically upward and downward.

In Forgione U.S. Pat. No. 4,059,413 issued Nov. 22, 1977, shows a grille having bars that slide vertically through holes in the window sill from a secured position to an escape position.

In Franklin U.S. Pat. No. 1,110,678 issued Sept. 15, 1914, shows hook members which slide in channels that are affixed to the window frame.

None of the patents described above discloses an apparatus like that used in the present invention.

SUMMARY OF THE INVENTION

In accordance with the present invention, there is provided a grille that includes a set of parallel bars supported at their ends by cross members. The grille is removably inserted into the frame of a door or window and is secured to the frame with the bars extending in the direction of motion of a slidable sash. A flange extends from the slidable sash into the space between the bars, and the bars extend through clearance holes in the flange. This permits the flange to slide freely along the bars.

The grille may cover up to half of the window. When the grille is in place, the window may be opened to any desired degree up to the maximum extent permitted by the grille.

It is an object of the present invention to provide a security grille apparatus that is easy to install in existing windows and doorways and that can be removed rapidly in case of emergency.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a front elevation view of a door showing the security grille of the present invention installed in it;

FIG. 2 is a cross sectional view in the direction 2—2 indicated in FIG. 1;

FIG. 3 is a cross sectional view comparable to FIG. 2 and showing an alternative embodiment of the present invention; and;

DETAILED DESCRIPTION OF THE PREFERRED EMBODIMENT

Figure 4:
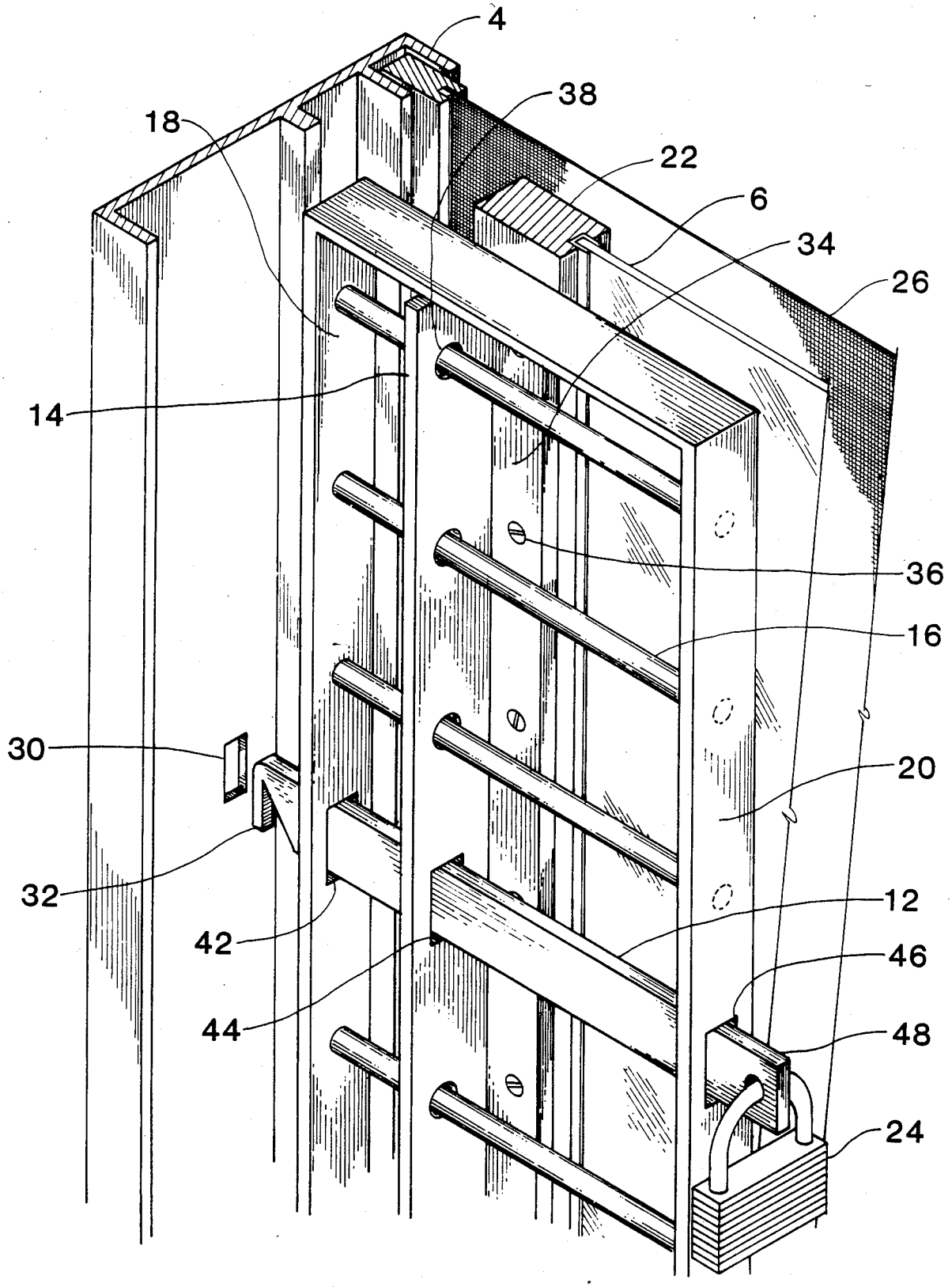
FIG. 4 is a fractional perspective view showing the security grille of the present invention in greater detail.

Turning now to the drawings, in which the same numeral is used throughout to designate like parts, there is shown in FIGS. 1, 2 and 4 a preferred embodiment of the present invention. FIG. 1 is a view from inside a house or building looking out through the door.

The present invention is intended to be installed in doorways or windows of a type having a frame 4 that extends all around the doorway or window, a slidable sash 6, and a fixed sash 8. Normally, the slidable sash 6 and the fixed sash 8 are equal in size. The slidable sash 6 includes a frame 22 that extends around its periphery.

In a preferred embodiment, the grille 10 is a ladder-like structure that includes a set of parallel bars 16 that are supported by the cross members 18, 20 to which the bars are welded. In an alternative embodiment, the grille is molded plastic.

As shown in FIG. 1, the grille 10 is of such a size and shape that it can be set into the frame 4 and secured there.

FIGS. 1 and 4 show one way of securing the grille 10 in the frame 4. As best seen in FIG. 4, the cross members 18, 20 include clearance holes 42, 46 that permit a locking bar 12 to be passed through the grille. One end of the locking bar 12 includes a beak 32 that is worked into the hole 30 to the position shown in FIG. 1. Thereafter, the grille 10 is slid laterally into place as the end 48 of the locking bar is passed through the holes 42, 44, and 46. Thereafter, the lock 24 prevents removal of the grille 10 from the locking bar 12. In another embodiment, shown in FIG. 3, a bracket 40 is mounted to the frame 4, and a hasp on the cross member 18 is locked to the bracket 40 to secure the grille 10 to the frame 4.

The angle iron 34 includes a flange 14 that extends into the space between the bars 16. The flange 14 includes clearance holes of which the hole 38 is typical, to pass the bars 16. The angle iron 34 must be assembled into place on the bars 16 before the bars are welded to the cross members 18, 20, since the flange 14 is captive on the bars 16

After the grille 10 has been set into the frame 4, but not necessarily secured to it, the angle iron 34 is attached to the frame 22 of the slidable sash 6 by means of screws of which the screw 36 is typical.

Thereafter, as the slidable sash 6 is slid to any open position, the grille 10 remains stationary, and the flange 14 moves along the bars 16. The bars 16 remain in a fixed position to prevent entry through the opening formed when the sash 6 is moved.

If the flange 14 were not present, it is possible that an intruder could force the grille into the interior of the building and away from the slidable sash 6.

The grille 10 of the present invention does not interfere with normal operation of the door or window. The slidable sash 6 may be opened to any desired degree, and the grille 10 assures the security of the door or window. As shown in FIG. 2, a slidable screen 26 is sometimes used, but the grille 10 in no way interferes with it. As shown in FIG. 3, a fixed screen 28 is sometimes included in the window, and again, the grille 10 does not interfere with it.

In the event of a fire or other emergency, the grille 10 can be quickly removed from the window from the inside. In the embodiment shown in FIG. 2, the slidable screen 26 must be opened, and the lock 24 must be unlocked. Thereafter, the grille 10 along with the slidable sash 6 are slid open together permitting the occupant to escape. In the embodiment of FIG. 3, the lock 24 must be unlocked, and thereafter the grille 10 along with the slidable sash 6 are slid open exposing the stationary screen 28, which the fleeing occupant must break through or remove.

Although the figures show the security grille lg apparatus installed in a door or window of the type in which the slidable sash 6 slids sideways, it is apparent that the apparatus could also be effectively employed in situations where the slidable sash 6 moves vertically.

Thus, there has been described a security grille apparatus that can be fitted into existing doors and windows with a minimum of modification and that secures those doors and windows while permitting the door or window to be opened to a desired degree.

As discussed above, the grille apparatus is easy to install and to remove and has the further advantage of being easily opened from within the building in case of fire or other emergency.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. Apparatus for securing a window that has a slidable sash mounted in a window frame, said apparatus comprising:

a grille including a set of parallel bars and attached to the window frame with said parallel bars extending in the direction of motion of the slidable sash; and, a flange extending from said slidable sash into the space between the parallel bars and including clearance holes that permit the parallel bars to extend through said flange so that said flange is slidable along said parallel bars.

2. The apparatus of claim 1 wherein said grille further comprises two cross members spaced apart along the parallel bars and attached to the parallel bars and between which said flange is captive on the parallel bars.

3. The apparatus of claim 1 further comprising means for removably attaching said grille to the window frame.

4. Apparatus for securing a doorway that has a door slidably mounted in a door frame, said apparatus comprising:

a grille including a set of parallel bars and attached to the door frame with said parallel bars extending in the direction of motion of the door; and, a flange extending from said door into the space between the parallel bars and including clearance holes that permit the parallel bars to extend through said flange so that said flange is slidable along said parallel bars

5. The apparatus of claim 4 wherein said grille further comprises two cross members spaced apart along the parallel bars and attached to the parallel bars and between which said flange is captive on the parallel bars.

6. The apparatus of claim 1 further comprising means for removably attaching said grille to the door frame.

* * * * *